US005906663A

United States Patent [19]

Brown et al.

[11] Patent Number: 5,906,663

[45] Date of Patent: May 25, 1999

[54] FUEL OIL COMPOSITIONS

[75] Inventors: Gerald Ivan Brown; Dhanesh Gordon Goberdhan, both of Oxford, United Kingdom

[73] Assignee: Exxon Chemical Patents Inc., Linden, N.J.

[21] Appl. No.: 08/849,657

[22] PCT Filed: Dec. 5, 1995

[86] PCT No.: PCT/EP95/04805

§ 371 Date: Oct. 23, 1997

§ 102(e) Date: Oct. 23, 1997

[87] PCT Pub. No.: WO96/17905

PCT Pub. Date: Jun. 13, 1996

[30] Foreign Application Priority Data

Dec. 6, 1994 [GB] United Kingdom ..... 9424565

[51] Int. Cl.[6] ..... C10L 1/18

[52] U.S. Cl. ..... 44/393; 44/395

[58] Field of Search ..... 44/393, 395

[56] References Cited

U.S. PATENT DOCUMENTS

| | | | |
|---|---|---|---|
| 4,713,088 | 12/1987 | Jack et al. | 44/395 |
| 5,205,839 | 4/1993 | Reimann | 44/395 |
| 5,254,652 | 10/1993 | Reimann et al. | 526/331 |
| 5,681,359 | 10/1997 | Botros | 44/393 |
| 5,716,915 | 2/1998 | Brown et al. | 44/393 |
| 5,718,734 | 2/1998 | Davies | 44/393 |
| 5,743,923 | 4/1998 | Davies et al. | 44/395 |

*Primary Examiner*—Jacqueline V. Howard

*Attorney, Agent, or Firm*—Ohlandt, Greeley, Ruggiero & Perle

[57] ABSTRACT

Additive compositions comprising an ethylene/vinyl acetate or propionate/vinyl branched carboxylate terpolymer and an ethylene-unsaturated ester copolymer improve the low temperature properties of fuel oils.

15 Claims, No Drawings

FUEL OIL COMPOSITIONS

This Application is a 371 of PCT/EP95/04805 filed Dec. 5, 1995.

This invention relates to oil compositions, primarily to fuel oil compositions, and more especially to fuel oil compositions susceptible to wax formation at low temperatures, and to additive compositions for such fuel oil compositions.

Fuel oils, whether derived from petroleum or from vegetable sources, contain components that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this, causing the wax to adopt an acicular habit, the resulting needles being more likely to pas through a filter than are platelets. The additives may also have the effect of retaining in suspension in the fuel the crystals that have formed, the resulting reduced settling also assisting in prevention of blockages.

A further problem encountered at temperatures low enough for wax to form in a fuel is the settlement of the wax to the lower region of any storage vessel. This has two effects; one in the vessel itself where the settled layer of wax may block an outlet at the lower end, and the second in subsequent use of the fuel. The composition of the wax-rich portion of fuel will differ from that of the remainder, and will have poorer low temperature properties than that of the homogeneous fuel from which it is derived.

There are various additives available which change the nature of the wax formed, so that it remains suspended in the fuel, achieving a dispersion of waxy material throughout the depth of the fuel in the vessel, with a greater or lesser degree of uniformity depending on the effectiveness of the additive on the fuel.

Although the way in which CFPP depressants and wax anti-settling additives function is not completely understood, there is evidence that their effectiveness depends to a significant extent on matching of the alkanes in the fuel to alkyl or alkylene chains in the additive, the growth of the alkane wax crystals being affected, for example, by the co-crystallization of an alkyl chain of similar length in an additive.

EP-A-493,769 describes the use of certain terpolymers as additives for petroleum distillates, in particular their use in improving the flowability of middle distillates as measured by the Cold Filter Plugging Point (CFPP) test. The terpolymers are made by polymerising ethylene, vinyl acetate, and vinyl neo-nonanoate or decanoate.

A problem in using said terpolymers is that, although their CFPP performance is satisfactory immediately after they are used to treat a distillate fuel, the CFPP performance of a so-treated fuel deteriorates with time. Such deterioration over time is referred to herein as 'CFPP regression'.

The present invention provides a way of meeting the problem of CFPP regression encountered with such terpolymers, by use of a specific co-additive. Through use of such a co-additive, excellent CFPP performance is also achieved.

Thus, a first aspect of the invention is an oil-soluble additive comprising components (A) and (B) wherein (A) is an ethylene terpolymer having, in addition to units derived from ethylene, units of the formula:

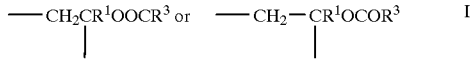

I and units of the formula

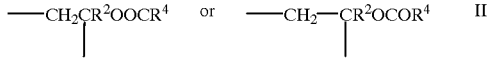

II wherein $R^1$ and $R^2$, which may be the same or different, each represents H or methyl;

$R^3$ represents an alkyl group having up to 4 carbon atoms; and $R^4$ represents a tertiary alkyl group having 8 or more carbon atoms; and (B) is an ethylene-unsaturated ester copolymer, different from (A), having a number average molecular weight in the range of 1,200 to 20,000 and an ester content of 0.3 to 17 molar per cent, provided that said ester content is at least 2 molar per cent lower than that of the esters in (A), or any other nucleating cold flow additive.

A second aspect of the invention is a composition comprising a fuel oil and an additive as defined in the first aspect of the invention.

A third aspect of the invention is an additive concentrate composition comprising an additive as defined in the first aspect of the invention and a liquid carrier in admixture therewith.

A fourth aspect of the invention is the use of an additive of the first aspect of the invention or a concentrate composition of the third aspect of the invention to improve the low temperature properties of an oil.

The examples herein will demonstrate the effectiveness of (B) in overcoming or at least reducing the above-mentioned problem of CFPP regression arising from the use of certain terpolymers.

The features of the invention will now be discussed in further detail as follows.

COMPONENT (A)

The term "terpolymer", as used herein, requires the polymer to have at least three different repeat units, i.e., be derivable from at least three different monomers, and includes polymers derivable from four or more monomers. For example, the polymer may contain two or more different units of the formula I or II, and/or may contain units of the formula

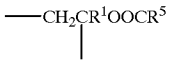

III wherein $R^5$ represents a hydrocarbyl group having 5 or more carbon atoms other than one as defined by $R^4$.

As used in this specification the term "hydrocarbyl" refers to a group having a carbon atom directly attached to the rest of the molecule and having a hydrocarbon or predominantly hydrocarbon character. Among these, there may be mentioned hydrocarbon groups, including aliphatic, (e.g., alkyl), alicyclic (e.g., cycloalkyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulfur, and preferably oxygen. Advantageously, the hydrocarbyl group contains at most 30, preferably at most 15, more preferably at most 10 and most preferably at most 8, carbon atoms.

The terpolymer may also contain units of formulae other than those mentioned above, for example units of the formula $$—CH_2—CHR^6— \quad \text{IV}$$

where $R^6$ represents —OH, or of the formula $$—CCH_3(CH_2R^7)—CHR^8 \quad \text{V}$$

where $R^7$ and $R^8$ each independently represent hydrogen or an alkyl group with up to 4 carbon atoms, the units V advantageously being derived from isobutylene, 2-methylbut-2-ene, 2-methylpent-2-ene, or di-isobutylene.

In units of the formula I which are preferably $—CH_2—CR^1—OOCR^3$, $R^1$ advantageously represents hydrogen, and $R^3$ advantageously represents ethyl or, especially, methyl. Advantageously $R^3$ is not t-butyl, but otherwise may be straight-chain or branched. In units of the formula II which are preferably $—CH_2—CR^2OOCR^4$, $R^2$ advantageously represents hydrogen. $R^4$ may represent a tertiary alkyl group having from 8 to 15 carbon atoms; preferably $OOCR^4$ represents neononanoate or neodecanoate.

As indicated above, it is within the scope of the invention to provide a terpolymer containing a mixture of different species of $R^3$ and/or $R^4$. It is also within the scope of the invention to provide a composition comprising a mixture of two or more terpolymers according to the first aspect of the invention.

The ester-containing units of the terpolymer, more especially the units of Formulae I and II, advantageously represent from 2.3 to 35 molar per cent of the polymer. The terpolymer is preferably the type known as arrestors, such as described in U.S. Pat. No. 3,961,916, in which the ester groups advantageously constitute from 7.5 to 35 molar per cent, preferably from 10 to 25, and more preferably from 10 to 20, and most preferably 10 to 17, molar per cent. Preferably, the molar per cent is 15 or more.

The molar proportion of the units of the formula I in the terpolymer is preferably in the range of from 1 to 9 percent, and the molar proportion of the units of the formula II in the terpolymer is preferably in the range of from 4 to 13 percent.

The terpolymer advantageously has a number average molecular weight, Mn, as measured by gel permeation chromatography, of at most 20,000. Its molecular weight is, generally, at most 14,000, advantageously at most 10,000, more advantageously in the range of 1,400 to 7,000, preferably 3,000 to 6,000 and most preferably from 3,500 to 5,500.

Preferably, the degree of branching (or linearity) of the terpolymer, as measured by proton NMR spectroscopy is less than 15, more preferably 10, most preferably 6 $CH_3$ groups per 100 $CH_2$ units. The linearity is corrected for the number of terminal methyl groups, based on the number average molecular weight (a relatively small correction) and, more importantly, for the number of methyl and methylene groups in the alkyl groups of the carboxylate side chains.

COMPONENT (B)

Without wishing to be bound by any theory, applicant believe that component (B) may function as a nucleating agent (or nucleator) such as described in U.S. Pat. No. 3,961,916. Preferably, it is an ethylene-unsaturated ester copolymer, for example where the unsaturated ester is a vinyl ester of a $C_2$ to $C_{10}$ aliphatic monocarboxylic acid such as vinyl acetate, vinyl propionate, vinyl n-butyrate, vinyl n-hexanoate, vinyl n-octanoate, vinyl 2-ethyl hexanoate, vinyl $C_9$ or $C_{10}$ neo acid esters.

Preferably, the number average molecular weight of component (B) is up to 15,000, more preferably from 1,200 to 10,000 and most preferably from 3,000 to 10,000.

The ester groups of component (B) advantageously represent up to 10, more advantageously from 0.3 to 7.5, and preferably from 3.5 to 7.0 molar per cent thereof.

Preferably, the ester content of component (B) is at least 3 molar per cent lower than the content of the esters in component (A).

(B) may contain other monomer units, to be a ter- or higher polymer. Examples of such other units include isobutylene and di-isobutylene.

Advantageously, the proportion by weight of component (B), based on the weight of (A) and (B) combined, is 10% or less, preferably in the range of 5% to 2%.

Examples of other nucleators are those known in the art such as those with polyoxyalkylene chains as described for example in EP-A-61,895; JP-2-51477 & 3-34790; EP-A-117,108; EP-A-326,356; and EP-A-356,256.

Examples of polyoxyalkylene compounds include polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkylene group in said polyoxyalkylene glycol containing from 1 to 4 carbon atoms, as described in EP-A-61 895 and in U.S. Pat. No. 4,491,455.

The preferred esters, ethers or ester/ethers which may be used may comprise compounds in which one or more groups (such as 2, 3 or 4 groups) of formula $—OR^{25}$ are bonded to a residue E, where E may for example represent A (alkylene) q, where A represents C or N or is absent, q represents an integer from 1 to 4, and the alkylene group has from one to four carbon atoms, A (alkylene)q for example being $N(CH_2CH_2)_3$; $C(CH_2)_4$; or $(CH_2)_2$; and $R^{25}$ may independently be (a) n-alkyl- (b) n-alkyl-CO—

(c) n-alkyl-OCO—$(CH_2)_n$—

(d) n-alkyl-OCO—$(CH_2)_n$CO— n being, for example, 1 to 34, the alkyl group being linear and containing from 10 to 30 carbon atoms. For example, they may be represented by the formula $R^{23}OBOR^{24}$, $R^{23}$ and $R^{24}$ each being defined as for $R^{25}$ above, and B representing the polyalkylene segment of the glycol in which the alkylene group has from 1 to 4 carbon atoms, for example, polyoxymethylene, polyoxyethylene or polyoxytrimethylene moiety which is substantially linear, some degree of branching with lower alkyl side chains (such as in polyoxypropylene glycol) may be tolerated but it is preferred that the glycol should be substantially linear.

Suitable glycols generally are substantially linear polyethylene glycols (PEG) and polypropylene glycols (PPG) having a molecular weight of about 100 to 5,000, preferably about 200 to 2,000. Esters are preferred and fatty acids containing from 10 to 30 carbon atoms are useful for reacting with the glycols to form the ester additives, it being preferred to use $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred when the petroleum based component is a narrow boiling distillate, when minor amounts of monoethers and monoesters (which are often formed in the manufacturing process) may also be present. It is important for active performance that a major amount of the dialkyl compound is present. In particular, stearic or behenic diesters of polyethylene glycol, polypropylene glycol or polyethylene/polypropylene glycol mixtures are preferred.

FUEL OIL

The oil may be fuel oil such as a petroleum-based fuel oil, suitably a middle distillate fuel oil, i.e. a fuel oil obtained in refining crude oil as the fraction between the lighter kerosene and jet fuels fraction and the heavier fuel oil fraction. Such distillate fuel oils generally boil within the range of about 100° C. to about 500° C., e.g. 150° to about 400° C. The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oils or of both.

Heating oils may be made of a blend of virgin distillate, e.g. gas oil, naphtha, etc and cracked distillates, e.g. catalytic cycle shock. A representative specification for a diesel fuel includes a minimum flash point of 38° C. and a 90% distillation point between 282 and 380° C. (see ASTM Designations D-396 and D-975).

The fuel oil may be an animal, vegetable or mineral oil. The fuel oil may also contain other additives such as stabilisers, dispersants, antioxidants, corrosion inhibitors and/or demulsifiers.

The concentration of the additive in the oil may for example in the range of 1 to 5,000 ppm of additive (active ingredient) by weight per weight of fuel, for example 10 to 5,000 ppm such as 10 to 2000 ppm (active ingredient) by weight per weight of fuel, preferably 25 to 500 ppm, more preferably 100 to 200 ppm.

The additive or additives should be soluble in the oil to the extent of at least 1000 ppm by weight per weight of oil at ambient temperature. However, at least some of the additive may come out of solution near the cloud point of the oil in order to modify the wax crystals that form.

CONCENTRATES

The concentrates of the present invention are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; paraffinic hydrocarbons such as hexane and pentane and isoparaffins; and bio-derived carrier liquids. The carrier liquid must, of course, be selected having regard to its compatibility with the additive and with the fuel.

The additives of the invention may be incorporated into bulk oil by other methods such as those known in the art. If co-additives are required, they may be incorporated into the bulk oil at the same time as the additives of the invention or at a different time.

CO-ADDITIVES

The additive of the invention may be used in combination with one or more additional cold flow improver additives, such as are known in the art (see, for example WO 93/14178), including comb polymers, polar nitrogen compounds, hydrocarbon polymers, and polyoxyalkylene compounds.

The additives of the invention may be used singly or as mixtures. They may also be used in combination with one or more co-additives such as known in the art, for example the following: detergents, antioxidants, corrosion inhibitors, dehazers, demulsifiers, metal deactivators, antifoaming agents, cetane improvers, cosolvents, package compatibilisers and antistatic additives.

EXAMPLES

The following Examples, in which number average molecular weight ($M_n$) are measured by gel permeation chromatography with polystyrene as standard, illustrate the invention.

MATERIALS USED

Additive Components

A: an ethylene-vinyl acetate- versatic vinyl ester terpolymer, sold commercially by Hoechst under the trade-name "Dodiflow-v-4159" in the form of a concentrate of 50% by weight active ingredient. The total vinyl ester content measured by NMR was 37.9% by weight; the $M_n$ by GPC was 3,600; and the number of methyl groups per 100 $CH_2$ groups was 4.2.

"Versatic" is a trademark for a mixture of a cyclic and (mostly) tertiary acids containing 9–11 C atoms made by the action of carbon monoxide and water on refinery olefins with an acid catalyst.

B: an ethylene-vinyl acetate copolymer of number average molecular weight 5000 as measured by GPC (Gel Permeation Chromatography) and containing 13.5% by weight of vinyl acetate in the form of a concentrate of 45% by weight active ingredient.

Formulations

The following formulations of A and B were prepared

| | Weight Ratios | |
|---|---|---|
| Formulation | A | B |
| 1 | 100 | 0 |
| 2 | 98 | 2 |
| 3 | 95 | 5 |
| 4 | 90 | 10 |

Fuel Oil

A middle distillate petroleum fuel oil having the following characteristics:

| | |
|---|---|
| Density | 0.8812 |
| Cloud Point | −5° C. |
| CFPP | −6° C. |
| IBP | 180 |
| Distillation Characteristics (D-86) (all ° C.) | |
| 10% | 226 |
| 20% | 243 |
| 50% | 280 |
| 90% | 341 |
| FBP | 372 |

IBP is initial boiling point
FBP is final boiling point

TEST METHOD (CFPP)

The CFPP test which is carried out by the procedure described in detail in "Journal of the Institute of Petroleum", Volume 52, Number 510, June 1966, pp. 173–285, is designed to correlate with the cold flow of a middle distillate in automotive diesels.

In brief, a sample of the oil to be tested (40 ml) is cooled in a bath which is maintained at about −34° C. to give non-linear cooling at about 1° C./min. Periodically (at each one degree centigrade starting from above the cloud point), the cooled oil tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage, the oil is returned immediately to the CFPP tube. The test is repeated with each one degree drop in temperature until the oil fails to fill the pipette within 60 seconds, the temperature at which failure occurs being reported as the CFPP temperature.

TEST PROCEDURE

The above formulations (1 to 4) were each dissolved in samples of the fuel oil at a total concentration of 200 ppm by weight of additive per weight of fuel oil. The CFPP of each treated fuel oil sample was measured immediately after treatment and then at successive weekly intervals up to 4 weeks after the initial treatment.

RESULTS

| | TIME IN WEEKS | | | | |
|---|---|---|---|---|---|
| FORMULATION | 0 | 1 | 2 | 3 | 4 |
| 1 | −18 | −10 | −12 | −10 | −13 |
| 2 | −20 | −18 | −19 | −18 | −17 |
| 3 | −21 | −20 | −19 | −21 | −19 |
| 4 | −22 | −20 | −21 | −20 | −18 |

The result show the deterioration (or regression) with time in CFPP performance when additive A (formulation 1) was used alone, but that inclusion of additive B (formulations 2–4) greatly reduced regression. Formulations 2 to 4 also showed excellent CFPP performance in comparison to formulation 1, at equivalent points in time over the test period.

We claim:

1. An oil-soluble additive comprising components (A) and (B) wherein (A) is an ethylene terpolymer having, in addition to units derived from ethylene, units of the formula:

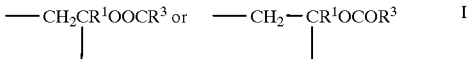

I and units of the formula

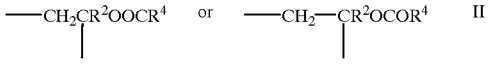

II wherein $R^1$ and $R^2$, which may be the same or different, each represents H or methyl;

$R^3$ represents an alkyl group having up to 4 carbon atoms; and $R^4$ represents a tertiary alkyl group having 8 or more carbon atoms; and (B) is an ethylene-unsaturated ester copolymer, different from (A), having a number average molecular weight (Mn) in the range of 1,200 to 20,000 and an ester content of 0.3 to 17 molar per cent, provided that said ester content is at least 2 molar per cent lower than that of the esters in (A), or any polyoxyalkylene cold flow additive.

2. The additive of claim 1 wherein $R^1$ represents hydrogen and $R^3$ represents methyl.

3. The additive of claim 2 wherein the units of the formula (II) are

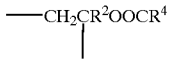

wherein $OOCR^4$ represents neonanoate or neodecanoate.

4. The additive of claim 1, wherein the total molar proportion of units of the formulae I and II in (A) is within the range of from 2.3 to 35 per cent.

5. The additive of claim 1, wherein the number average molecular weight (Mn) of (A) is within the range of from 3,000 to 6,000.

6. The additive of claim 1 wherein the unsaturated ester forming the ethylene-unsaturated ester copolymer (B) is a vinyl ester.

7. The additive of claim 1 wherein the proportion of (B) by weight, based on the weight of (A) and (B) combined, is 10% or less.

8. A composition comprising a fuel oil and the additive as defined in claim 1.

9. An additive concentrate composition comprising the additive as defined in claim 1 and a liquid carrier in admixture therewith.

10. A composition comprising a fuel oil and the additive as defined in claim 3.

11. An additive concentrate composition comprising the additive as defined in claim 3 and a liquid carrier in admixture therewith.

12. A process for inhibiting regression over time of the flowability of a fuel oil composition as measured by the Cold Filter Plugging Point comprising adding to the fuel oil an oil-soluble additive as defined in claim 1.

13. A process for inhibiting regression over time of the flowability of a fuel oil composition as measured by the Cold Filter Plugging Point comprising adding to the fuel oil an oil-soluble additive as defined in claim 3.

14. The process of claim 12 wherein the fuel oil is a middle distillate petroleum fuel oil.

15. The process of claim 13 wherein the fuel oil is a middle distillate petroleum fuel oil.

* * * * *